US008266989B2

(12) United States Patent
Hu

(10) Patent No.: US 8,266,989 B2
(45) Date of Patent: Sep. 18, 2012

(54) EXTENSION FOR WRENCH

(76) Inventor: Bobby Hu, Taichung (TW)

( * ) Notice: Subject to any disclaimer, the term of this patent is extended or adjusted under 35 U.S.C. 154(b) by 444 days.

(21) Appl. No.: 12/560,504

(22) Filed: Sep. 16, 2009

(65) Prior Publication Data

US 2010/0319499 A1 Dec. 23, 2010

(30) Foreign Application Priority Data

Jun. 19, 2009 (TW) ..... 98120712 A

(51) Int. Cl.
*B25B 23/16* (2006.01)

(52) U.S. Cl. ..... 81/177.2; 81/177.1

(58) Field of Classification Search ..... 81/177.1, 81/177.2

See application file for complete search history.

(56) References Cited

U.S. PATENT DOCUMENTS 3,912,315 A * 10/1975 Yamanaka ..... 292/335
7,677,140 B2 * 3/2010 Hull et al. ..... 81/177.2
2008/0148908 A1 * 6/2008 Lin ..... 81/177.2

* cited by examiner

*Primary Examiner* — Lee D Wilson
*Assistant Examiner* — Shantese McDonald
(74) *Attorney, Agent, or Firm* — Alan Kamrath; Kamrath IP Lawfirm, PA

(57) ABSTRACT

A wrench includes a handle having first and second ends spaced along a longitudinal axis. The second end of the handle includes a first receptacle extending in a radial direction perpendicular to the longitudinal axis. The handle further includes a second receptacle intermediate the first and second ends along the longitudinal axis. The second end of the handle is slideably received in an extension. A positioning hole extends from an inner periphery through an outer periphery of the extension. A first positioning member is mounted in the first receptacle and biased by a first spring to extend through the positioning hole, with a portion of the first positioning member pressing against the inner periphery of the extension. A second positioning member is mounted in the second receptacle and biased by a second spring to press against the inner periphery of the extension.

12 Claims, 9 Drawing Sheets

EXTENSION FOR WRENCH

BACKGROUND OF THE INVENTION

1. Field of the Invention

The present invention relates to an extension for a wrench and, more particularly, to an extension reliably and releasably coupled to an end of a handle of a wrench.

2. The Prior Arts

Wrenches with a short handle are more useful than wrenches with a long handle in small spaces but provide small torque. To save costs, an extension is attached to the short handle of the wrench to increase the arm of force, and the extension can be detached to allow use of the wrench in a small space. FIG. 1 shows a conventional arrangement for coupling an extension 50 to an end 33 of a handle 32 of a wrench 30. Wrench 30 includes a head 31 with a drive portion 34 for driving a fastener. End 33 includes a receptacle 331 receiving an engaging device 40 comprised of a positioning member 41 and a spring 42. Positioning member 41 includes a larger section and a smaller section 411 having an outer diameter smaller than that of the larger section that is slideably received in receptacle 331. Extension 50 includes a tubular member 51 having an engaging portion 52 with a positioning hole 521. End 33 of handle 32 is inserted into tubular member 51. Spring 42 biases the smaller section of positioning member 41 into positioning hole 521 of tubular member 51 to position end 33 of handle 32 in tubular member 51. To allow easy coupling between tubular member 51 and handle 32, a spacing A (FIG. 2) must be provided between end 33 of handle 32 and an inner periphery of tubular member 51. However, end 33 of handle 32 wobbles in tubular member 51 due to the existence of spacing A. Furthermore, spacing A becomes larger after a period of time of use, leading to undesired disengagement of positioning member 41 from positioning hole 521.

Thus, a need exists for an extension that can be reliably and releasably coupled to an end of a handle of a wrench to increase the arm of force.

SUMMARY OF THE INVENTION

The present invention solves this need and other problems in the field of increasing the arm of force for a wrench by providing, in a preferred form, a wrench including a head having a drive portion adapted to drive an object. The wrench further includes a handle having a first end interconnected to the head and a second end spaced from the first end along a longitudinal axis. The second end of the handle includes a first receptacle extending in a radial direction perpendicular to the longitudinal axis. An extension includes a tubular member defining a longitudinal hole. The second end of the handle is slideably received in the longitudinal hole along the longitudinal axis. The tubular member has inner and outer peripheries spaced in the radial direction. The tubular member further includes a positioning hole extending from the inner periphery through the outer periphery of the tubular member and in communication with the longitudinal hole. A first positioning member is mounted in the first receptacle. The first positioning member includes a body and first and second sections. The second section is intermediate the first section and the body in the radial direction. The body is slideably received in the first receptacle in the radial direction. Each of the first and second sections has first and second ends spaced in the radial direction. The first end of the second section is interconnected to the body. The second section has an outer diameter smaller than the body and larger than a diameter of the positioning hole. The first end of the first section is interconnected to the second end of the second section. The first section has an outer diameter smaller than the second section. The first section slideably extends through the positioning hole in the radial direction. A first spring is received in the first receptacle. The first spring biases the first section of the first positioning member to extend through the positioning hole with the second end of the first section outside of the tubular member, coupling the second end of the handle with the tubular member. The second end of the second section presses against the inner periphery of the tubular member. The second end of the first section is pushable in the radial direction to disengage from the positioning hole allowing disengagement of the tubular member from the second end of the handle.

In the most preferred form, the handle further includes a second receptacle intermediate the first and second ends of the handle along the longitudinal axis. A second positioning member is moveably received in the second receptacle in a direction perpendicular to the longitudinal axis. A second spring is received in the second receptacle and biases the second positioning member to press against the inner periphery of the tubular member. The first section has a first height in the radial direction, and the second section has a second height in the radial direction. A sum of the first and second heights is larger than a first spacing between a peripheral edge defining an opening of the first receptacle and the outer periphery of the tubular member in the radial direction. The second height of the second section is larger than a second spacing between the peripheral edge and the inner periphery of tubular member, so that the first end of the second section is spaced from the peripheral edge when the second end of the second section presses against the inner periphery of the tubular member under action of the first spring.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
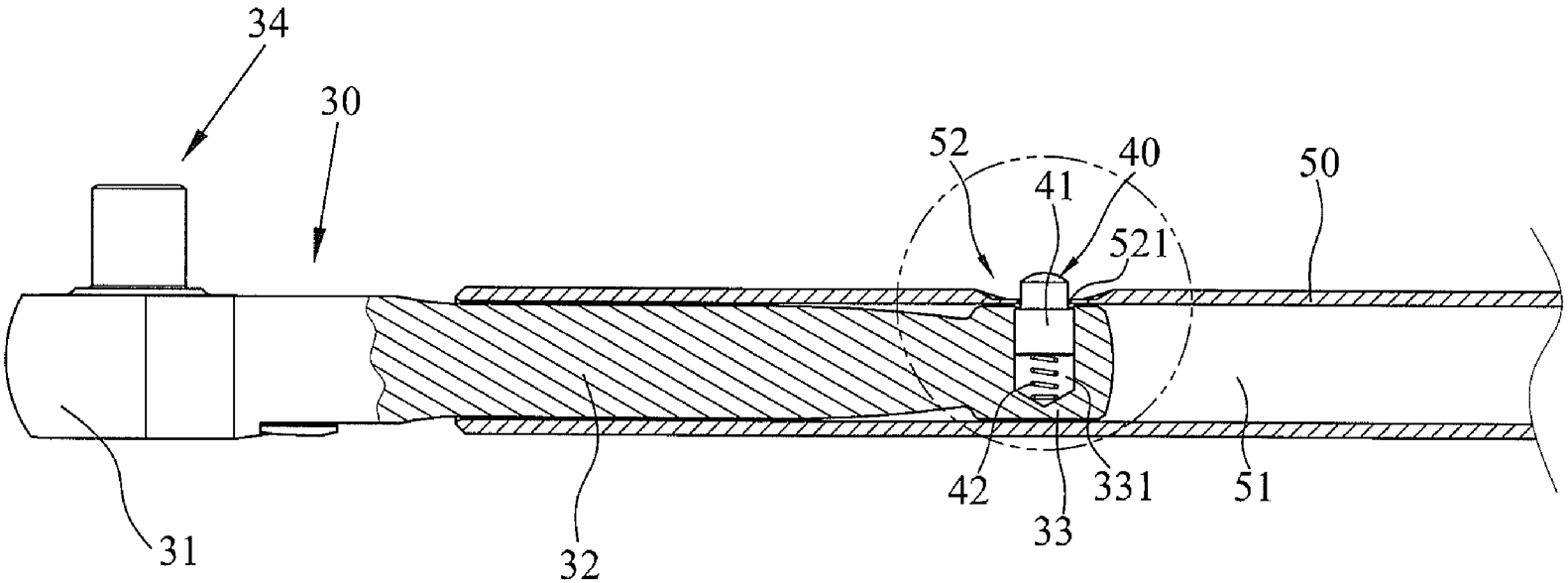
Fig. 1 Prior art
FIG. 1 shows a partial, side, cross sectional view of a wrench and an extension according to the prior art, with a portion of the wrench and a portion of the extension sectioned.
Figure 2:
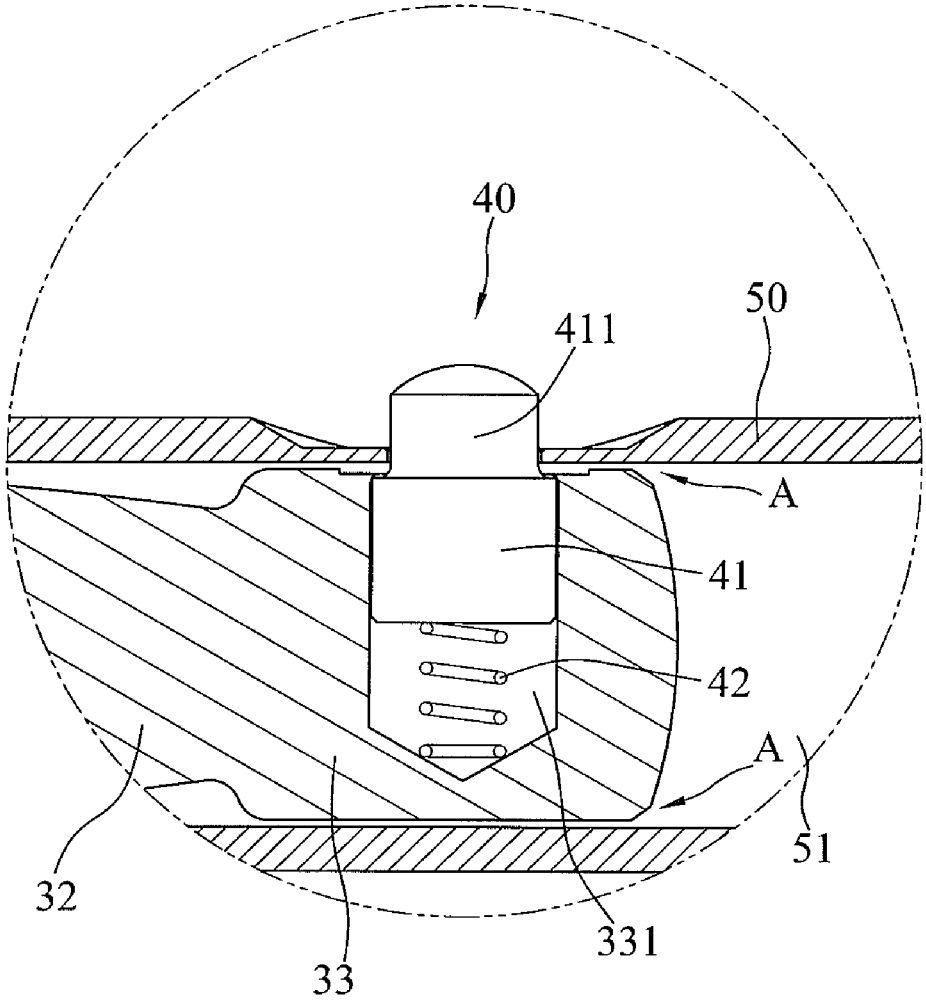
Fig. 2 Prior art
FIG. 2 shows an enlarged view of a circled portion of FIG. 1.
Figure 3:
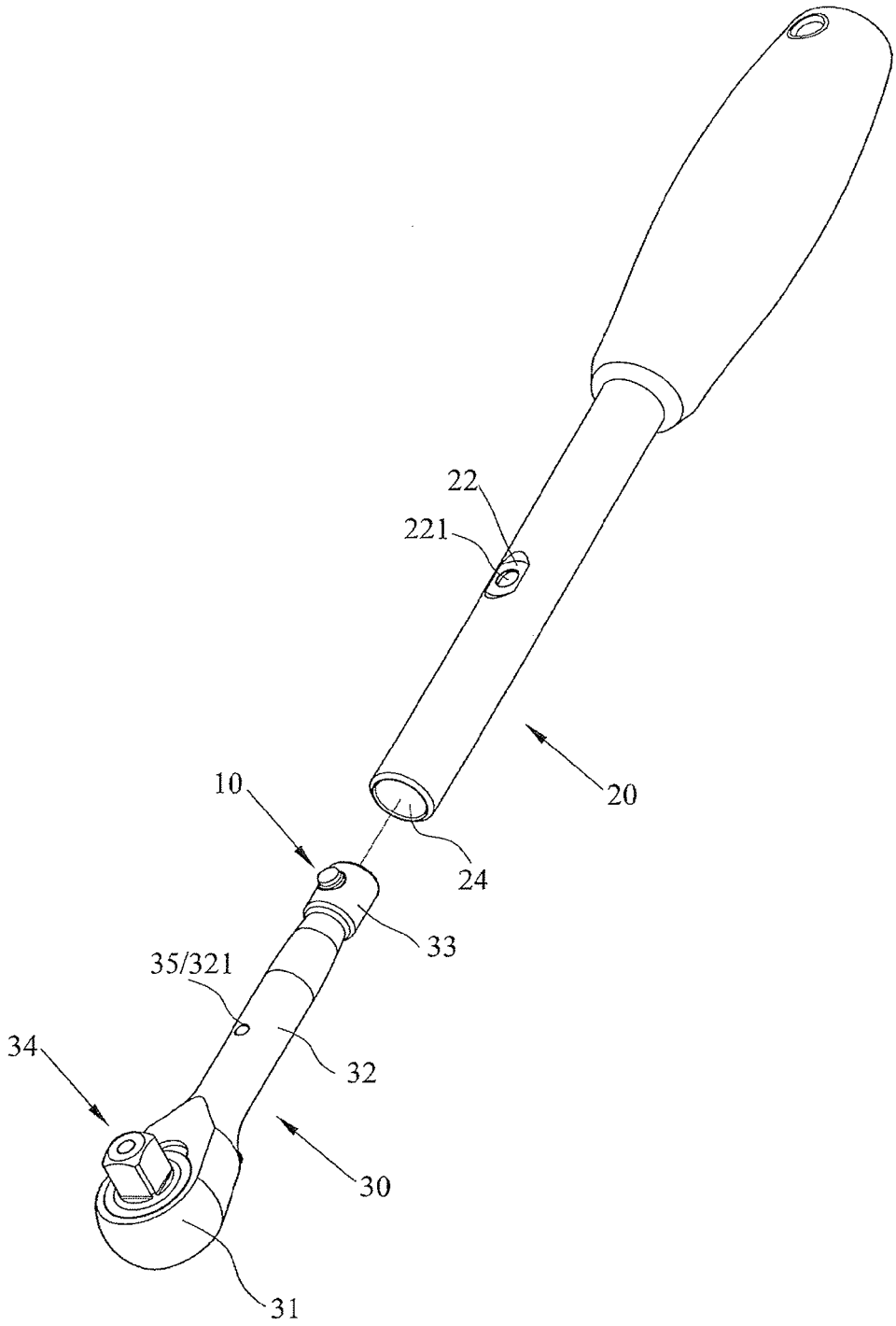
FIG. 3 shows an exploded, perspective view of a wrench and an extension according to the preferred teaching of the present invention.
Figure 4:
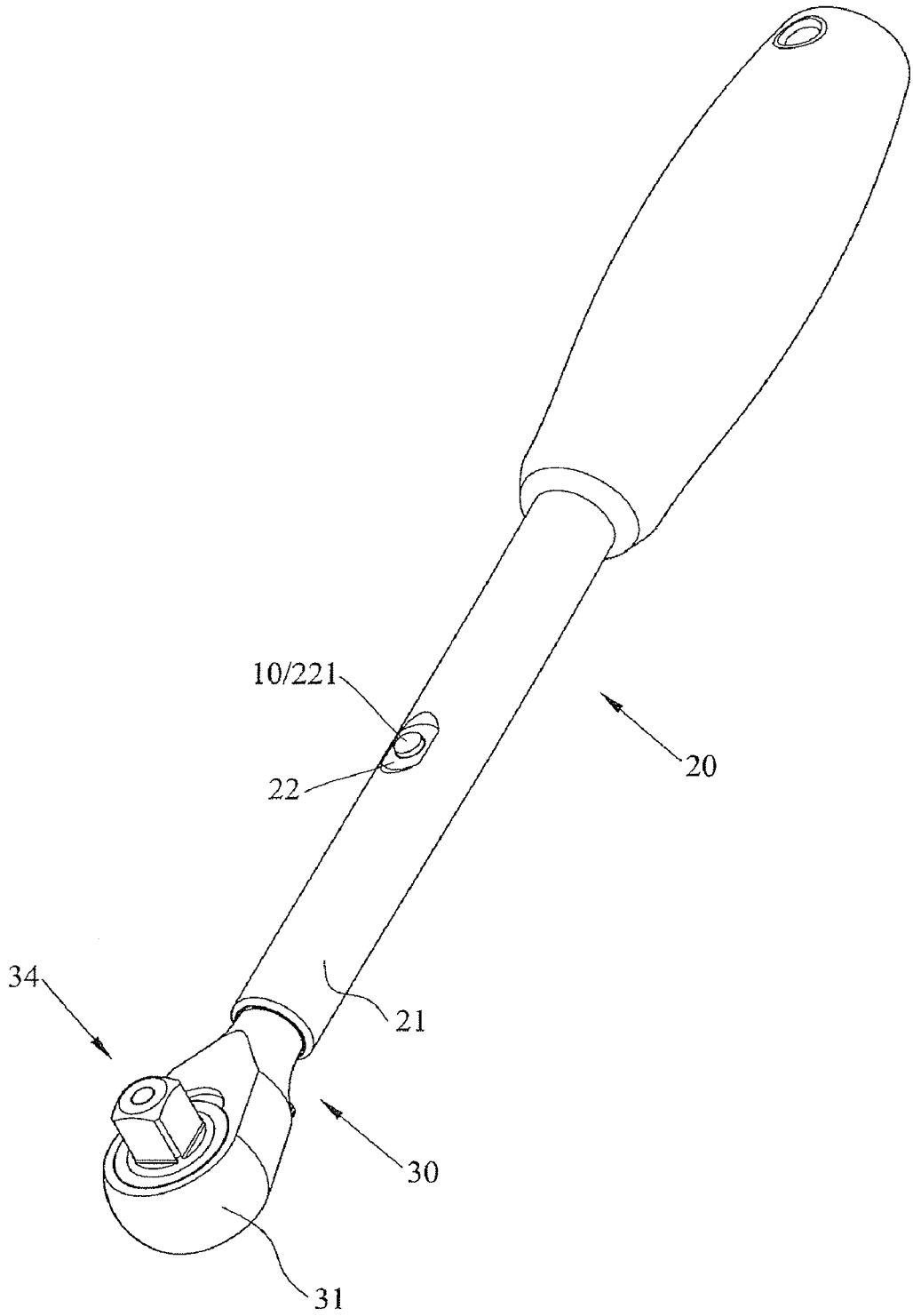
FIG. 4 shows a perspective view of the wrench and the extension of FIG. 3.
Figure 5:
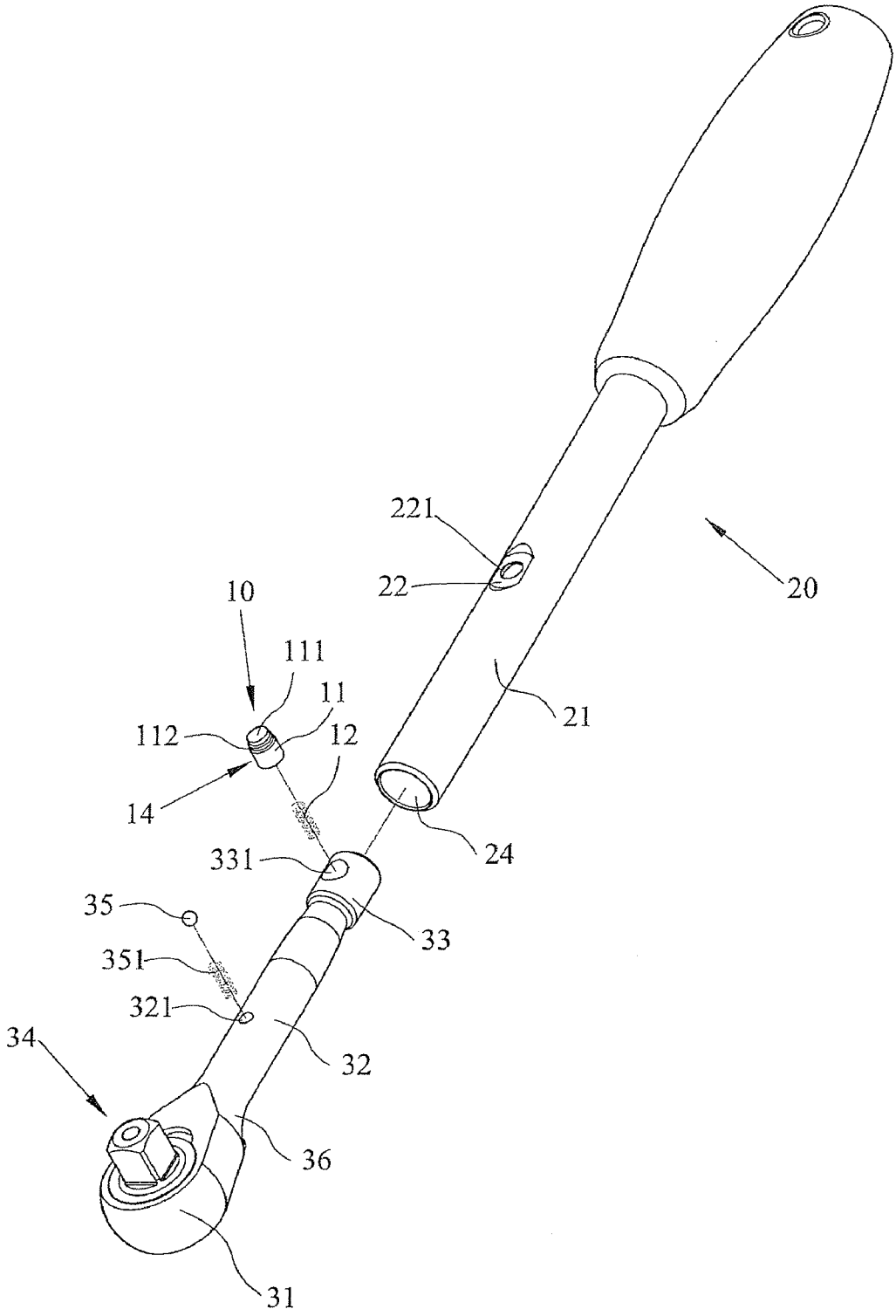
FIG. 5 shows another exploded, perspective view of the wrench and the extension of FIG. 3.
Figure 6:
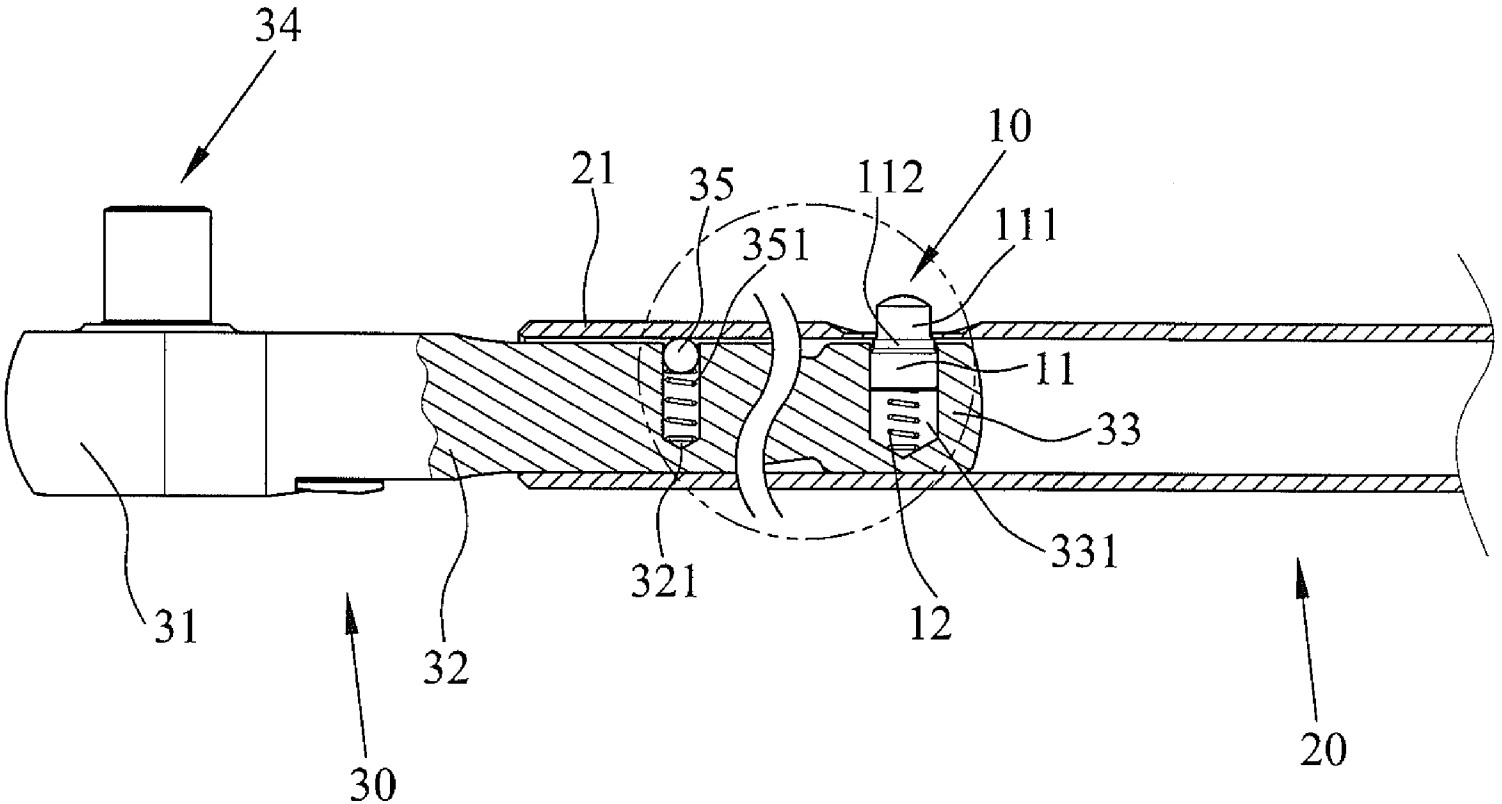
FIG. 6 shows a partial, side, cross sectional view of the wrench and the extension of FIG. 3, with a portion of the wrench and a portion of the extension sectioned.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "longitudinal", "radial", "inward", "spacing", "height", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

A combination of a wrench 30 and an extension 20 according to the preferred teachings of the present invention is shown in FIGS. 3-9. In the preferred form shown, wrench 30 includes a head 31 having a drive portion 34 in the form of a drive column for driving an object such as a bolt, a nut, etc. Other forms of drive portion 34 would be within the skill of the art. Wrench 30 further includes a handle 32 having a first end 36 interconnected to head 31 and a second end 33 spaced from first end 36 along a longitudinal axis. Second end 33 of handle 32 includes a first receptacle 331 extending in a radial direction perpendicular to the longitudinal axis. In the most preferred form shown, handle 32 further includes a second receptacle 321 intermediate first and second ends 33 and 36 along the longitudinal axis. Second receptacle 321 in the most preferred form shown is parallel to first receptacle 331.

In the preferred form shown, extension 20 includes a tubular member 21 defining a longitudinal hole 24. Second end 33 of handle 32 is slideably received in longitudinal hole 24 along the longitudinal axis. Tubular member 21 has inner and outer peripheries spaced in the radial direction. Tubular member 21 further includes an engaging portion 22 having a positioning hole 221 extending from the inner periphery through the outer periphery of tubular member 21 and in communication with longitudinal hole 24. In the most preferred form shown, engaging portion 22 is recessed from the outer periphery of tubular member 21.

In the preferred form shown, a first positioning member 10 is mounted in first receptacle 331. First positioning member 10 includes a body 11 and an engaging section 14. Engaging section 14 includes first and second sections 111 and 112. Second section 112 is intermediate first section 111 and body 11 in the radial direction. Body 11 is slideably received in first receptacle 331 in the radial direction. Second section 112 has first and second ends spaced in the radial direction. The first end of second section 112 is interconnected to body 11. Second section 112 has an outer diameter smaller than body 11 and larger than a diameter of positioning hole 221. First section 111 has first and second ends spaced in the radial direction. The first end of first section 111 is interconnected to the second end of second section 112. First section 111 has an outer diameter smaller than second section 112 and slightly smaller than positioning hole 221, so that first section 111 slideably extends through positioning hole 221 in the radial direction. In the most preferred form shown, an interconnection area between the second end of second section 112 and first end of first section 111 is rounded. Furthermore, first end of second section 112 and first end of first section 111 form a stepped section with a shoulder 16 having an outer diameter smaller than the diameter of first receptacle 331 and larger than the diameter of positioning hole 221.

After body 11 is received in first receptacle 331, a peripheral edge 333 (FIG. 9) defining an opening of first receptacle 331 can be processed to have a diameter slightly smaller than body 11 so that body 11 will not disengage from first receptacle 331.

In the preferred form shown, a first spring 12 is received in first receptacle 331. First spring 12 is mounted between a bottom wall of first receptacle 331 and body 11. When it is desired to attach extension 20 to handle 32, second end 33 of handle 32 is inserted into tubular member 21 with first positioning member 10 moved radially inward by the inner periphery of tubular member 21 to overcome first spring 12. When positioning hole 221 is aligned with first section 111 of first positioning member 10, first spring 12 biases first section 111 of first positioning member 10 to extend through positioning hole 221 with the second end of first section 111 outside of tubular member 21. Thus, second end 33 of handle 32 is coupled with tubular member 21. The second end of second section 112 (i.e., shoulder 16) presses against the inner periphery of tubular member 21 under action of first spring 12 when engaging section 14 is received in positioning hole 221. When desired to separate extension 20 from handle 32, the second end of first section 111 can be pushed in the radial direction to disengage from positioning hole 221, allowing disengagement of tubular member 21 from second end 33 of handle 32.

Figure 7:
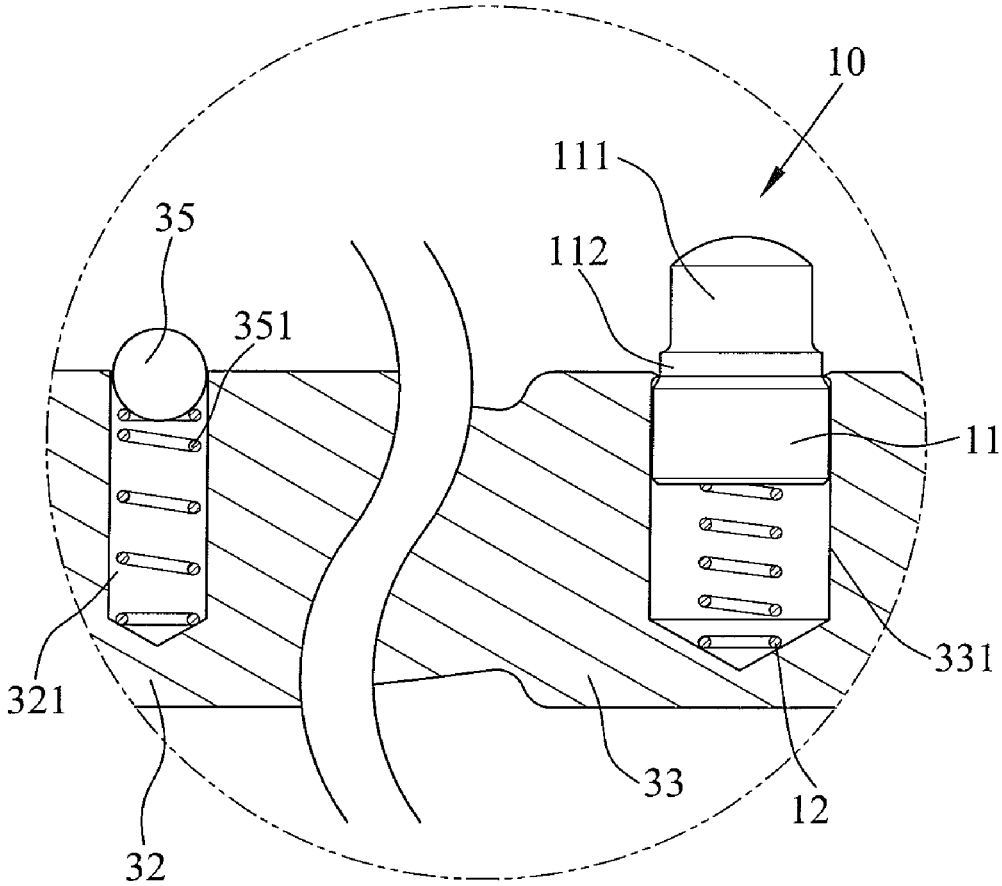
FIG. 7 is an enlarged view of a circled portion of FIG. 6 with the extension removed for clarity.
Figure 8:
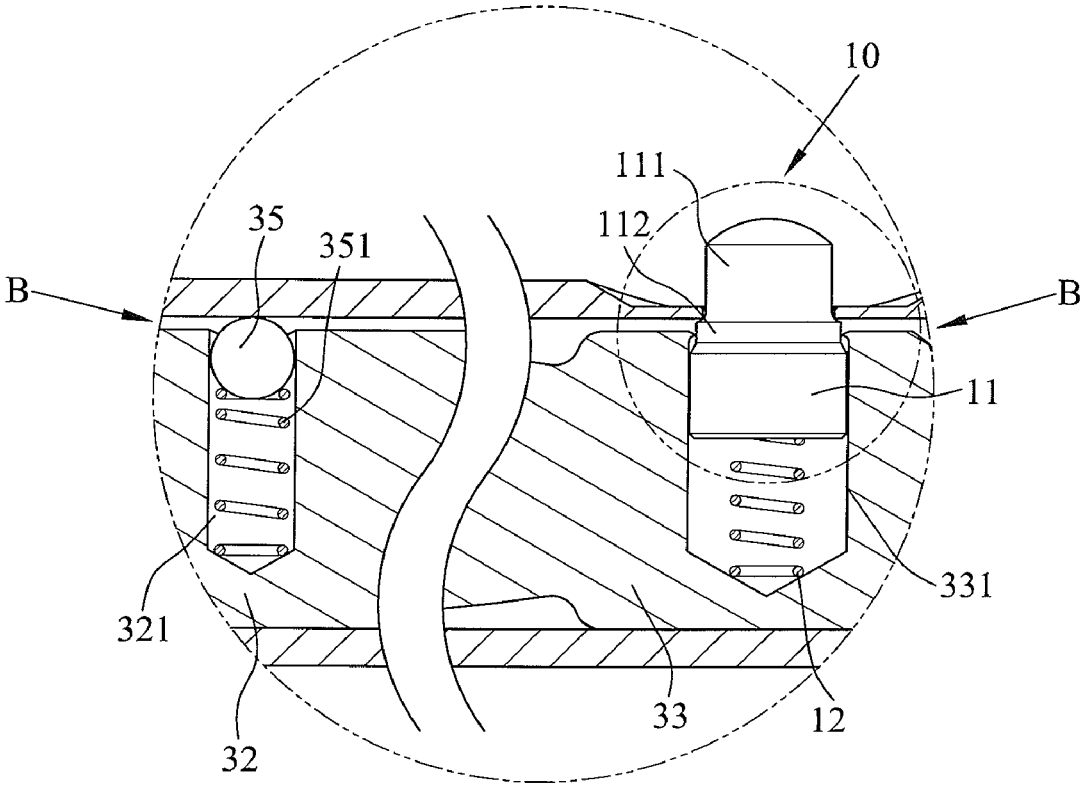
FIG. 8 shows an enlarged view of the circled portion of FIG. 6.
Figure 9:
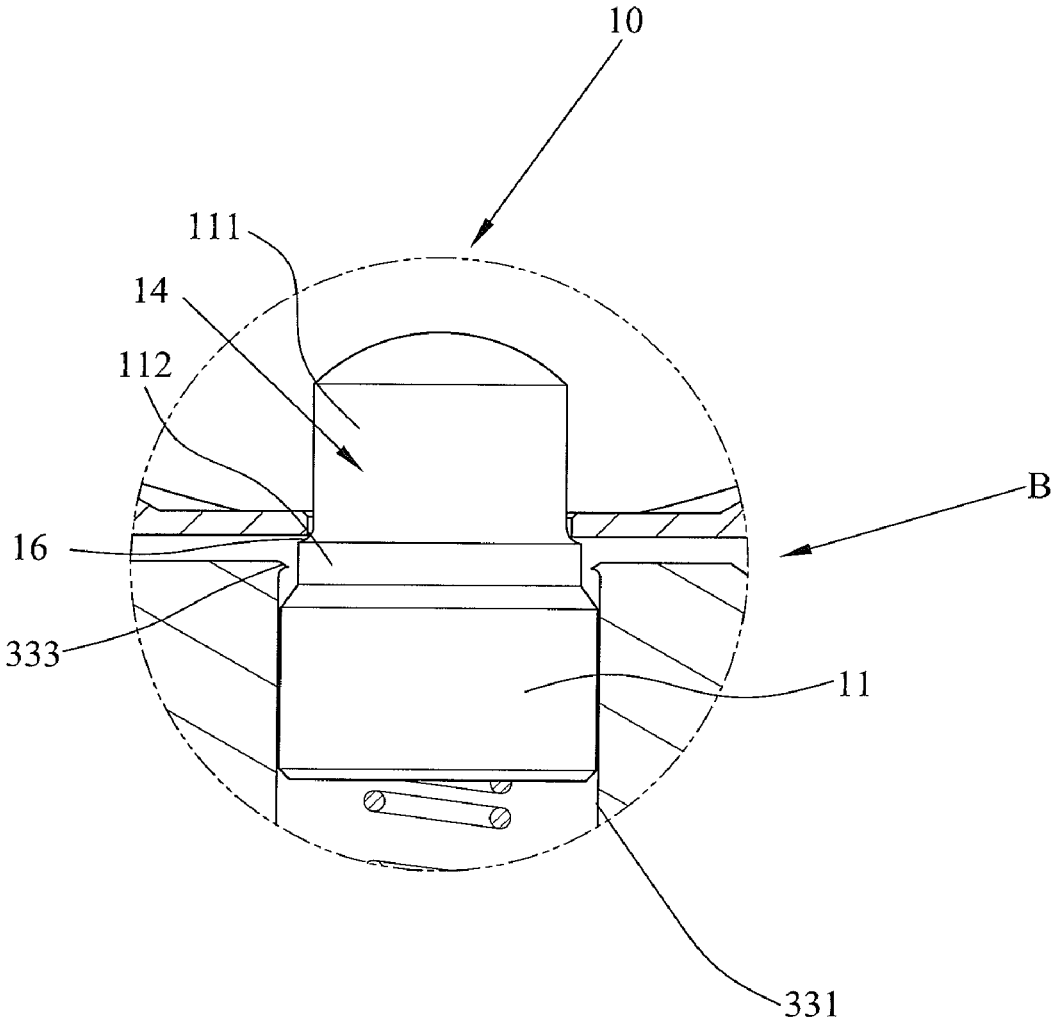
FIG. 9 shows an enlarged view of a circled portion of FIG. 8.

Referring to FIG. 7, when the wrench 30 is to be used without the extension 20, first spring 12 will bias first positioning member 10 so that body 11 is retained by peripheral edge 333. Engaging section 14 extends past peripheral edge 333 in the radial direction.

In the most preferred form shown, a second positioning member 35 in the form shown as a ball is moveably received in second receptacle 321 in a direction perpendicular to the longitudinal axis. Furthermore, a second spring 351 is received in second receptacle 321 and biases second positioning member 35 to press against the inner periphery of tubular member 21.

Thus, two radial retaining forces are respectively applied to two portions of the inner periphery of tubular member 21 spaced along the longitudinal axis of handle 32 by first and second positioning members 10 and 35, reliably retaining second end 33 of handle 32 in tubular member 21. Wobbling of second end 33 of handle 32 is minimized while providing spacing B between the inner periphery of tubular member 21 and handle 32 to allow easy insertion and removal of handle 32 into and from tubular member 21. Reliable operation of the combination including wrench 30 and extension 20 to provide a larger arm of force is, thus, allowed. Extension 20 can be detached from handle 32 when use of wrench 30 in a small space is required.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A combination comprising, in combination:

a wrench including a head having a drive portion adapted to drive an object, with the wrench further including a handle having a first end interconnected to the head and a second end spaced from the first end along a longitudinal axis, with the second end of the handle including a first receptacle extending in a radial direction perpendicular to the longitudinal axis;

an extension including a tubular member defining a longitudinal hole, with the second end of the handle slideably received in the longitudinal hole along the longitudinal axis, with the tubular member having inner and outer peripheries spaced in the radial direction, with the tubular member further including a positioning hole extending from the inner periphery through the outer periphery of the tubular member and in communication with the longitudinal hole;

a first positioning member mounted in the first receptacle, with the first positioning member including a body and first and second sections, with the second section intermediate the first section and the body in the radial direction, with the body slideably received in the first receptacle in the radial direction, with each of the first and second sections having first and second ends spaced in the radial direction, with the first end of the second section interconnected to the body, with the second section having an outer diameter smaller than the body and larger than a diameter of the positioning hole, with the first end of the first section interconnected to the second end of the second section, with the first section having an outer diameter smaller than the second section, with the first section slideably extending through the positioning hole in the radial direction; and a first spring received in the first receptacle, with the first spring biasing the first section of the first positioning member to extend through the positioning hole with the second end of the first section outside of the tubular member, coupling the second end of the handle with the tubular member, with the second end of the second section pressing against the inner periphery of the tubular member, with the second end of the first section being pushable in the radial direction to disengage from the positioning hole allowing disengagement of the tubular member from the second end of the handle.

2. The combination as claimed in claim 1, with the handle further including a second receptacle intermediate the first and second ends of the handle along the longitudinal axis, with the combination further comprising, in combination: a second positioning member moveably received in the second receptacle in a direction perpendicular to the longitudinal axis; and a second spring received in the second receptacle and biasing the second positioning member to press against the inner periphery of the tubular member.

3. The combination as claimed in claim 2, with the second positioning member being a ball.

4. The combination as claimed in claim 2, with the second receptacle being parallel to the first receptacle.

5. The combination as claimed in claim 1, with an interconnection area between the second end of the second section and the first end of the first section being rounded.

6. The combination as claimed in claim 1 with the body located intermediate the spring and the first and second sections.

7. The combination as claimed in claim 6 with the first receptacle extending radially from a side of the handle, with a space defined between the side and the inner periphery for inserting and removal of the handle in the longitudinal hole of the extension, with the second section located in the space when the second end of the second section presses against the inner periphery around the positioning hole.

8. The combination as claimed in claim 7 wherein a peripheral edge defining an opening of the first receptacle has a diameter smaller than a diameter of the body and larger than the outer diameters of the first and second sections, with the body abutting with the peripheral edge preventing disengagement of the first positioning member from the first receptacle.

9. The combination as claimed in claim 8, with the handle further including a second receptacle intermediate the first and second ends of the handle along the longitudinal axis, with the combination further comprising, in combination: a second positioning member moveably received in the second receptacle in a direction perpendicular to the longitudinal axis; and a second spring received in the second receptacle and biasing the second positioning member to press against the inner periphery of the tubular member, with the second receptacle extending radially from the side of the handle parallel to and spaced from the first receptacle, with the second positioning member located in the space.

10. The combination as claimed in claim 9, with the second positioning member being a ball.

11. The combination as claimed in claim 1 wherein a peripheral edge defining an opening of the first receptacle has a diameter smaller than a diameter of the body and larger than the outer diameters of the first and second sections, with the body abutting with the peripheral edge preventing disengagement of the first positioning member from the first receptacle.

12. The combination as claimed in claim 1 with the second end of the second section pressing against the inner periphery around the positioning hole.

* * * * *